US005968396A

United States Patent [19]

Rodriguez

[11] Patent Number: 5,968,396

[45] Date of Patent: Oct. 19, 1999

[54] WARMER INSERTABLE INTO BOTTLE

[76] Inventor: Nancy Rodriguez, 8617 Collett Ave., North Hills, Calif. 91343

[21] Appl. No.: 09/165,639

[22] Filed: Oct. 2, 1998

Related U.S. Application Data

[63] Continuation-in-part of application No. 08/734,032, Oct. 18, 1996.

[51] Int. Cl.[6] ..... H05B 3/06

[52] U.S. Cl. ..... 219/523; 219/437; 219/439; 219/441; 392/443

[58] Field of Search ..... 219/523, 437, 219/439, 441; 392/443

[56] References Cited

U.S. PATENT DOCUMENTS

| | | | |
|---|---|---|---|
| 1,445,501 | 2/1923 | Dwinall . | |
| 2,483,979 | 10/1949 | Morrill | 219/437 |
| 2,512,284 | 7/1950 | Mumford . | |
| 2,918,561 | 10/1959 | Cranley | 219/523 |
| 3,536,893 | 10/1970 | Cranley | 219/437 |
| 4,065,660 | 12/1977 | Berard . | |
| 4,108,181 | 8/1978 | Saliaris . | |
| 4,563,570 | 1/1986 | Johns . | |
| 4,857,702 | 8/1989 | Cafaro . | |
| 5,025,130 | 6/1991 | Slone . | |
| 5,118,927 | 6/1992 | Eisenhauer | 219/437 |
| 5,337,581 | 8/1994 | Lott . | |
| 5,408,068 | 4/1995 | Ng . | |
| 5,436,429 | 7/1995 | Cline . | |
| 5,706,390 | 1/1998 | O'Neill . | |

*Primary Examiner*—Tersa Walberg
*Assistant Examiner*—Vinod D Patel
*Attorney, Agent, or Firm*—Terrance L. Siemens

[57] ABSTRACT

A compact, portable warmer which is insertable into a bottle for the purpose of warming and stirring contents of the bottle. The warmer has a projecting heating element having a stainless steel sheath configured similarly to a paddle, and a cap for protecting the heating element from contamination and for protecting external objects from heat from the heating element. The portable warmer includes a battery for powering the heating element, an on-off switch, and an electrical cable for recharging the battery from a socket of a cigarette lighter of a motor vehicle.

3 Claims, 3 Drawing Sheets

WARMER INSERTABLE INTO BOTTLE

REFERENCE TO RELATED APPLICATION

This application is a Continuation-In-Part of Ser. No. 08/734,032, filed Oct. 18, 1996.

BACKGROUND OF THE INVENTION

1. Field of the Invention

The present invention relates to portable warmers, and more specifically, to a warmer which is insertable into a container for the purpose of warming and stirring contents of the container. The warmer has a projecting heating element and a cap for protecting the heating element from contamination and for protecting external objects from heat from the heating element.

2. Description of the Prior Art

When a person is travelling with an infant and wishes to feed the infant, heating food can be an impractical proposition. While adults are relatively able to adjust their eating practices to constraints imposed by travel, infants and small children are not so able. It is therefore desirable to have at hand heating equipment for heating food for infants and small children.

Generally, heating equipment is both relatively bulky and to a certain extent, dependent upon cooperation with objects in its immediate environmental for fuel, disposition of exhaust, or for an electric supply. A need exists for compact heating equipment for heating bottled food which is independent of external connection or ventilation for successful operation.

U.S. Pat. No. 1,445,501, issued to Harold F. Dwinall on Feb. 18, 1923, describes a hot water bag having an internal heater the projecting heating element of which is configured similarly to that of the present invention. However, the heater of Dwinall does not accommodate battery and controls, as seen in the present invention, nor can it be employed to stir the contents of the bottle, as can the present invention.

U.S. Pat. No. 2,512,284, issued to Manly S. Mumford on Jun. 20, 1950, addresses this need by providing a bottle warmer heated by chemical action, with suitable chemicals being provided in consumable cartridge form. By contrast, the present invention employs electricity for energy, and is partially immersed in a bottle being warmed, rather than surrounding the bottle.

U.S. Pat. No. 4,065,660, issued to Jean Claude Berard on Dec. 27, 1977, describes a bottle warmer having a heating element embedded in a blanket which is fastened around the bottle. In alternative embodiments, the blanket is either exposed or enclosed. Berard's device has a base enabling the device to stand upright on a horizontal surface. By contrast, the present invention has an integral battery, an electrical cable for recharging the battery, and is partially disposed within a bottle being warmed, rather than surrounding the bottle.

U.S. Pat. Nos. 5,408,068, issued to Wai-Man Ng on Apr. 18, 1995, and 5,436,429, issued to Mitchell T. Cline on Jul. 25, 1995, both illustrate electric warmers comprising essentially only blankets incorporating a heating element and an electrical feed conductor. The feed conductor in both cases is adapted to connect to the socket of a cigarette lighter in a motor vehicle. These devices lack the integral battery of the present invention, and also surround the subject bottle rather than being inserted thereinto, as is practiced with the present invention.

None of the above inventions and patents, taken either singly or in combination, is seen to describe the instant invention as claimed.

SUMMARY OF THE INVENTION

The present invention provides a heater suitable and practical for heating bottled food while traveling by motor vehicle. In contrast to prior art practice regarding food warming devices, the heating element is inserted into the bottle. This is advantageous in that it renders the heater more compact than would be the case if the heater were arranged to surround or even partially surround the bottle. This arrangement is further advantageous in that the food is heated from the center of its volume, so that relatively little heat is lost to ambient air. Therefore, the device is relatively efficient. In addition, heating efficiency is enhanced by manually stirring the food with the heating element.

This is an important consideration, in that the device is provided with a self-contained battery for storing electrical energy. In keeping with requirements for compactness, the battery should be as small and unobtrusive as possible. Therefore, conserving heat while heating minimizes capacity and thus size requirements of the battery. Of course, the battery renders operation of the heater independent of connection to an electrical supply.

An electrical cable is provided for recharging the battery. The cable terminates in a plug suitable for insertion into the socket of a cigarette lighter of a motor vehicle. This enables the battery to be recharged at a convenient time while traveling.

The heating element projects from the body of the heater. This arrangement is similar to that of engine block heaters, which are customarily immersed in liquid coolant or in liquid lubricant of an engine. However, engine heaters are typically called upon to heat a large mass, relative to the mass of bottled food. Also, the temperature differential when heating engines subjected to frigid temperatures is typically greater than that when heating bottled food. Therefore, power consumed by engine heaters is usually so great that it is not feasible to utilize battery power. Even if a battery is connected, it would generally be unsuitable to affix the battery rigidly to the heating element. An on-off switch switches power to the heating element regardless of the source of power. Also engine heating elements are not manipulable so as to stir the food being heated.

The heating element is broad and relatively thin, in the manner of a paddle. This characteristic has three benefits. One is that it enables the user to stir contents of a bottle. Secondly, when so configured, the heating element provides relatively great surface area for rapidly and evenly heating contents of a bottle, and avoids unduly displacing contents of the bottle while stirring. Thirdly, sharp corners of the rectangular element promote turbulence when stirring, so that food constituents are better and rapidly blended, and heat is and more quickly and evenly distributed throughout th efluent mass. The heating element is sheathed in stainless steel, which is chemically non-reactive in the environment of most foods.

The body is characterized by being an enclosure for a battery and also suitable as a handle for holding the novel heater. Also, the heating element is located on an opposite end of the body from the power cord and on-off switch. This combination of characteristics enables the novel heater to be readily wielded by hand, even to the point of using it to stir food and also as a hand held device which distributes heat from a moderate heat source over a broad area. Simultaneously, the electrical current can be switched manually both when hand held and when inserted into a bottle.

A cooperating cap is provided for covering the heating element when not heating contents of a bottle. This prevents contamination of the heating element, and also protects external objects from heat of the heating element. Engine heaters and similar devices having a cap cooperating closely with the heating element are not known to the applicant.

Accordingly, it is a principal object of the invention to provide a compact, portable device for heating and stirring bottled food.

It is another object of the invention to provide the heater with a projecting heating element for insertion into a bottle containing food to be heated and stirred.

It is a further object of the invention to provide a cap for covering the heating element when not in use.

Still another object of the invention is to provide an integral battery for providing operative power independently of connection to an external source of electrical power.

An additional object of the invention is to enable connection of the heater to the socket of a cigarette lighter of a motor vehicle for recharging the battery.

Still another object of the invention is to provide a sharp edged heating element to promote turbulence when stirring.

It is again an object of the invention to provide a durable and chemically non-reactive protective sheath for the heating element.

Yet another object of the invention is to provide a switch for controlling power to the heating element.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
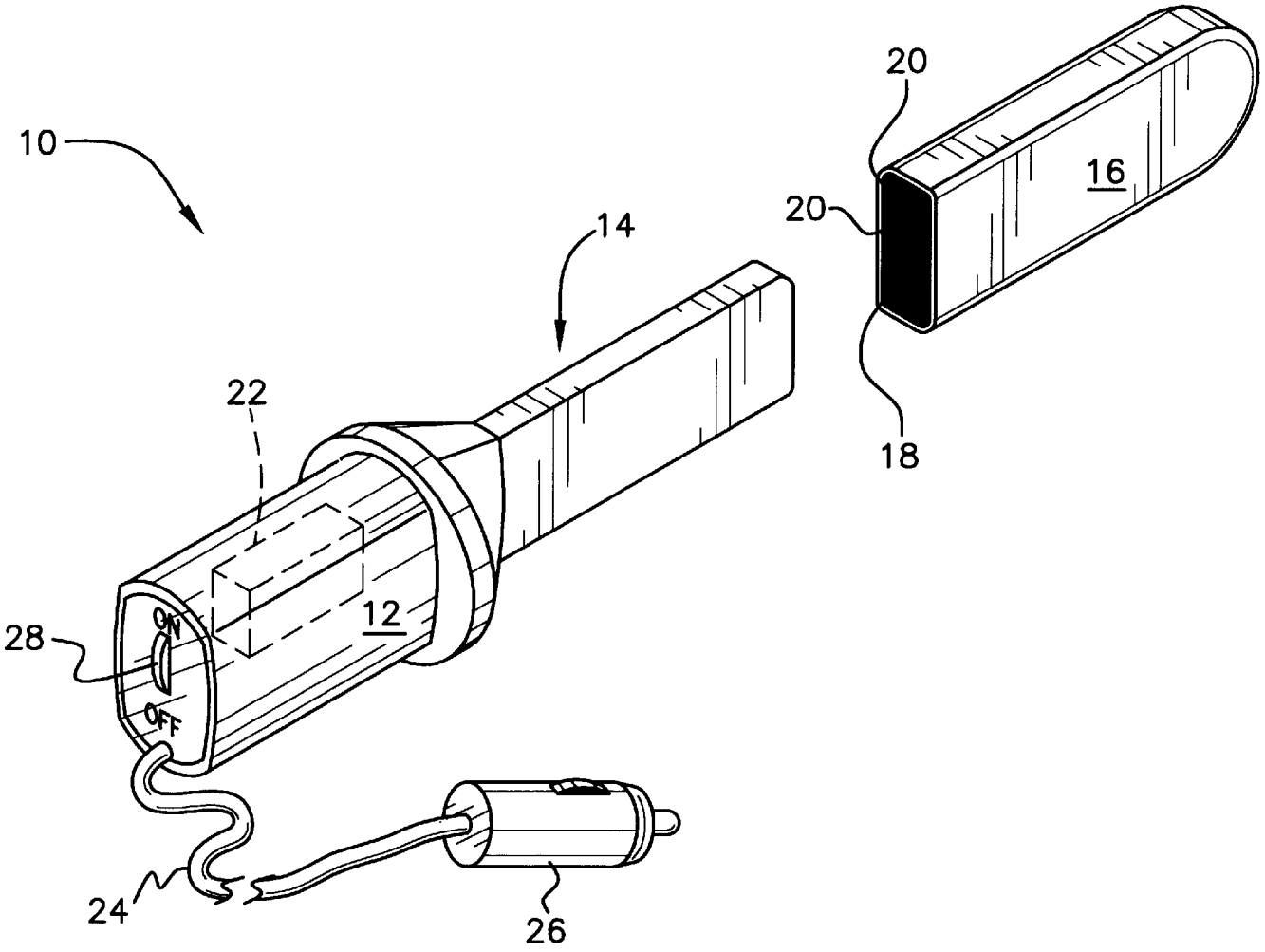
FIG. 1 is an exploded, perspective view of the invention.

Turning now to FIG. 1 of the drawings, novel compact, portable heater 10 is seen to comprise a body 12 having a proximal end and a distal end, and an electrical heating element assembly 14 projecting from the distal end of body 12. Body 12 serves both as an enclosure for electrical components of heater 10 and also as a handle for holding heater 10, and is configured to serve in this capacity. A removable cap 16 is provided for covering heating element 14 when not in use. Cap 16 fits closely to heating element 14, in particular having an open receptacle 18 which is dimensioned and configured to cooperate with heating element 14, and has relatively thin walls 20. Element 14 can be seen to have an elongated rectangular cross section having relatively sharp corner edges.

Portable heater 10 is provided with electrical power from two sources. A battery 22, which may comprise a plurality of commercially available cells, such as nickel cadmium cells, is enclosed within housing 12. Also, an electrical cable 24 having a male terminal 26 of the type compatible for connecting to a socket for a cigarette lighter (not shown) of a motor vehicle (not shown) is provided for recharging battery 22 or for direct powering of heating element assembly 14 should battery 22 be depleted. Cable 24 contacts body 12 at the proximal end thereof.

A switch 28 is accessible at the exterior of body 12 at the proximal end thereof, for electrically connecting and disconnecting battery 22 and cable 24 to heating element assembly 14. Switch 28 is accessible from the exterior of body 12 for operation by the user of heater 10.

Provision of both battery 22 and cable 24 enables heater 10 to be operated independently of connection of cable 24 to the socket for the cigarette lighter of the motor vehicle, and also enables battery 22 to be recharged while traveling in the motor vehicle.

Figure 2:
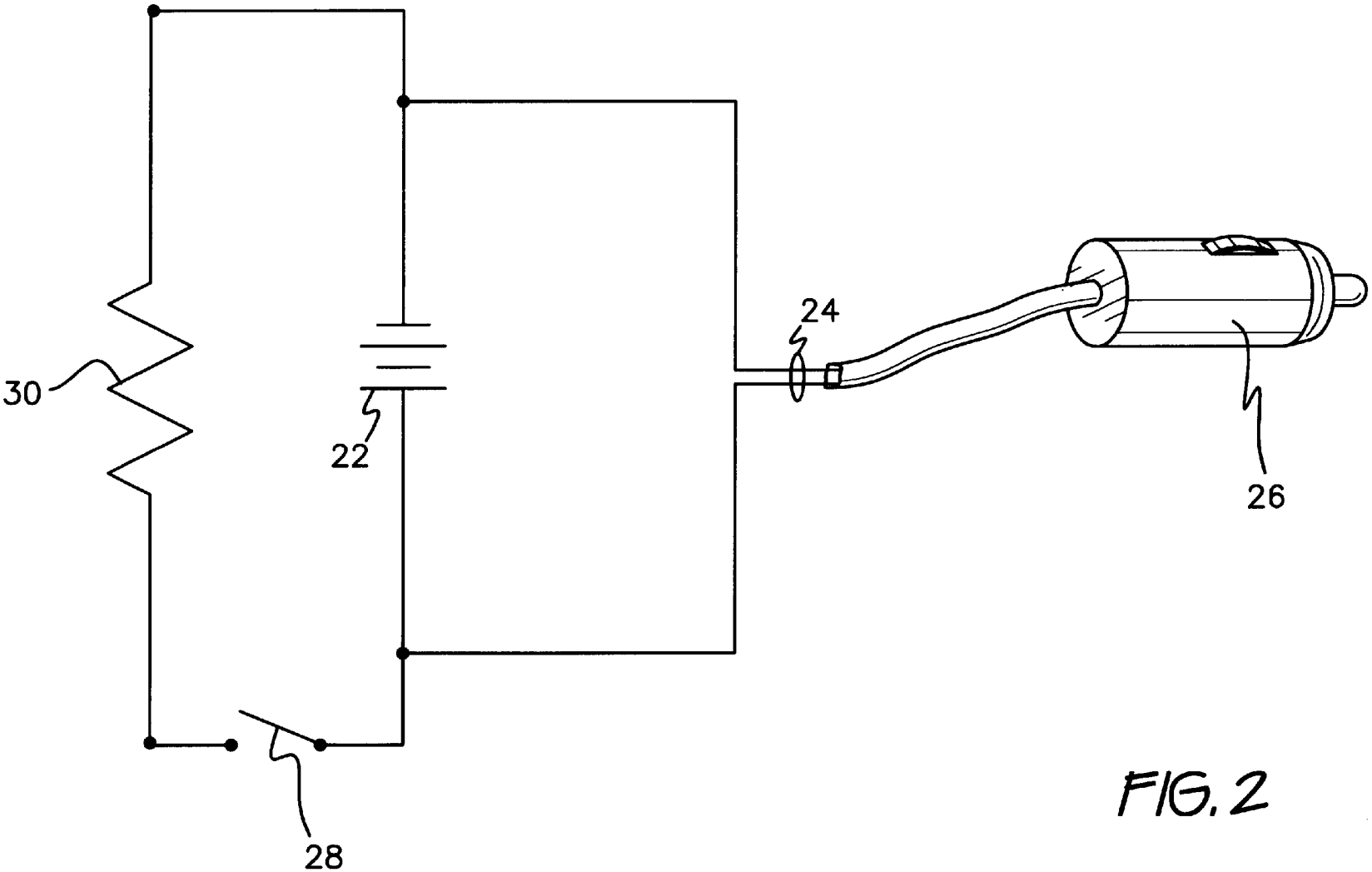
FIG. 2 is an electrical schematic diagram of the invention.

FIG. 2 shows electrical circuitry of heater 10. Battery 22 is seen to be disposed in parallel with cable 24, so that either may be utilized to energize heating element 30 when switch 28 is in the "on" position.

Heating element 30 may be of any well known, suitable type of electrical resistance heater. Preferably, element 30 has predetermined positive coefficient of temperature characteristics, for assuring that a predetermined maximum temperature is not exceeded. Alternatively, a thermally responsive snap action switch or any other thermostatic device (neither shown) may be employed for this purpose.

Where desired, thermostatic temperature control can be omitted. For example, in applications employing a battery 22 of quite limited capacity, the user may regulate heat output by periodically monitoring actual temperature of heating element assembly 14 by touch.

Figure 3:
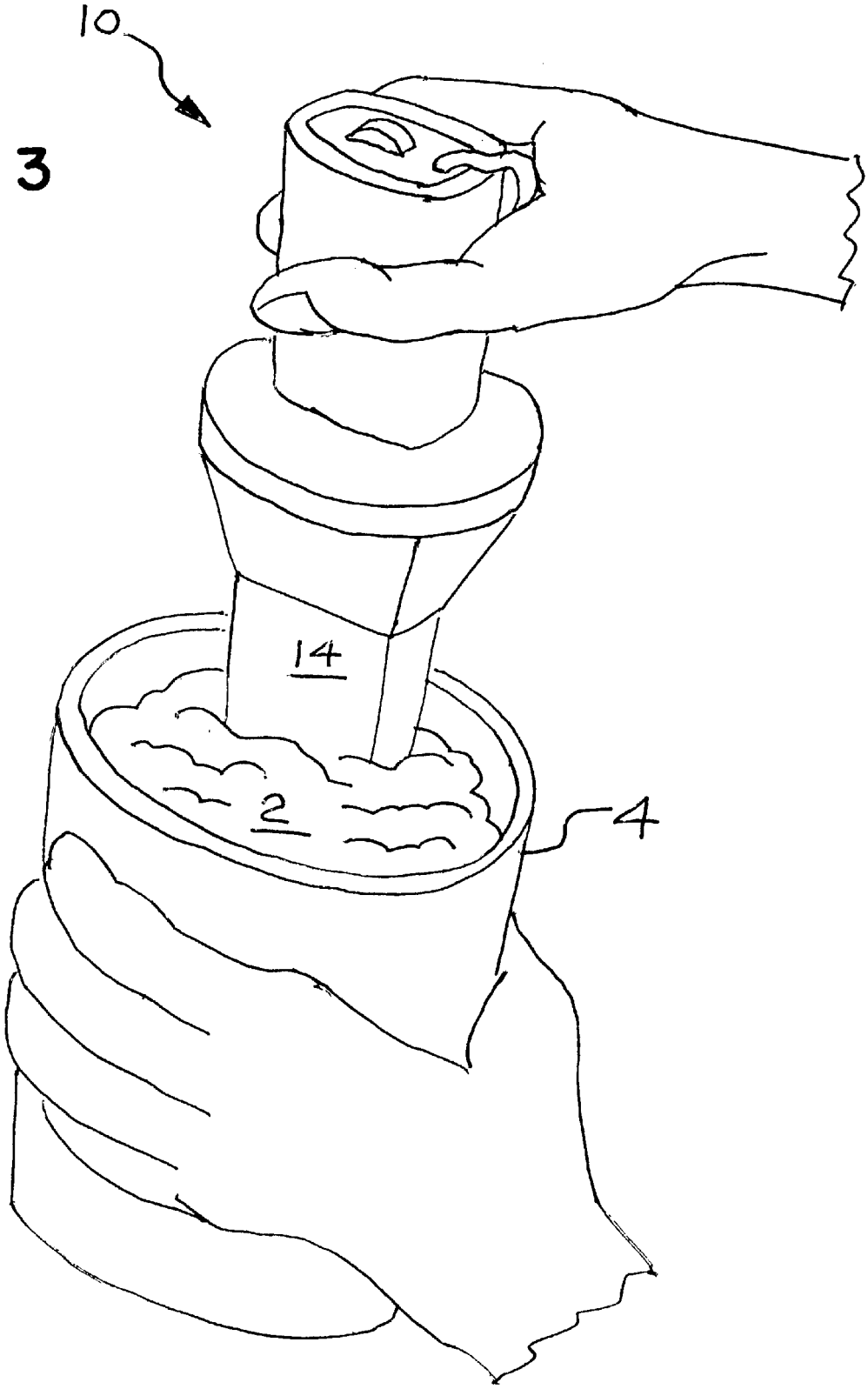
FIG. 3 is an environmental view of the invention, illustrating its use in stirring food.

FIG. 3 illustrates heater 10 as it would be employed to stir a fluent food material 2 in a bottle 4. Heater 10 is readily grasped by body 12, with heating element 14 projecting downwardly into food being prepared to feed a child. Heater 10 is dimensioned and configured to be comfortably and readily grasped and maneuvered for stirring.

It is to be understood that the present invention is not limited to the embodiments described above, but encompasses any and all embodiments within the scope of the following claims.

I claim:

1. A compact, portable bottle heater for heating and stirring food contents of a bottle, comprising:

a body having an exterior, a proximal end;

an elongated, generally rectangular in cross section electrical heating element projecting from said distal end of said body; and power means for providing electrical power to said heating element, comprising an electrical cable having a male terminal dimensioned and configured to connect to a socket of a cigarette lighter of a motor vehicle, said electrical cable contacting said body at said proximal end, a battery disposed in parallel with said electrical cable, said battery contained within said body, and control means for electrically connecting said electrical cable and said battery to said heating element, said control means including an on-off switch disposed at said proximal end of said body and accessible from said exterior of said body, wherein said body is configured to serve as an enclosure for said battery and also as a handle for holding said bottle heater, and said bottle heater is usable by grasping said body and stirring the food in the bottle with said heating element.

2. The compact, portable bottle heater according to claim 1, wherein said heating element is sheathed in stainless steel.

3. The compact, portable bottle heater according to claim 1, further comprising a removable cap dimensioned and configured to cooperate with said heating element, for covering said heating element.

* * * * *